US008844235B2

(12) United States Patent
Lukaszewicz

(10) Patent No.: US 8,844,235 B2
(45) Date of Patent: Sep. 30, 2014

(54) CLADDING RAIL, CLADDING FIXING SYSTEM AND METHOD

(75) Inventor: John Witold Lukaszewicz, Auckland (NZ)

(73) Assignee: Cladding Systems International Limited, Auckland (NZ)

( * ) Notice: Subject to any disclaimer, the term of this patent is extended or adjusted under 35 U.S.C. 154(b) by 161 days.

(21) Appl. No.: 13/284,059

(22) Filed: Oct. 28, 2011

(65) Prior Publication Data

US 2012/0104202 A1 May 3, 2012

(30) Foreign Application Priority Data

Oct. 28, 2010 (NZ) ..... 588871

(51) Int. Cl.
*E04C 2/00* (2006.01)
*E04F 13/08* (2006.01)

(52) U.S. Cl.
CPC ..... *E04F 13/0864* (2013.01); *E04F 13/083* (2013.01)
USPC ..... 52/551; 52/553; 52/506.06; 52/509; 52/510; 52/511; 52/512

(58) Field of Classification Search
USPC ..... 52/509–512, 546, 547, 551, 553, 52/506.06, 745.05, 745.09, 745.21
See application file for complete search history.

(56) References Cited

U.S. PATENT DOCUMENTS 4,685,263 A * 8/1987 Ting ..... 52/235
5,301,484 A 4/1994 Jansson
5,544,461 A * 8/1996 Sommerstein ..... 52/235
2008/0008433 A1 1/2008 Parker
2009/0241451 A1 10/2009 Griffiths

FOREIGN PATENT DOCUMENTS

EP 0550395 A1 7/1993
NZ 528380 2/2005
NZ 556322 7/2009

OTHER PUBLICATIONS

Examination Report issued on Nov. 2, 2011 in corresponding Patent Application No. 588871 by the Intellectual Property Office of New Zealand, 3 pages.
New Zealand Office Action dated Mar. 21, 2013; Publication No. 608287.

* cited by examiner

*Primary Examiner* — Charles A Fox
*Assistant Examiner* — Patrick Maestri
(74) *Attorney, Agent, or Firm* — Young & Thompson

(57) ABSTRACT

A mounting rail for mounting a cladding panel in a lapped formation on a wall includes an elongate body shaped in cross section having a vertical upstanding rear flange mountable to a wall, a downwardly extending front flange and a sloping web portion extending from the rear to the front flange. The web portion also includes a downwardly extending channel portion receiving at least an upper portion of a lower panel. The front flange portion forms an upward facing channel portion slidably receiving a lower portion of an upper panel. The mounting rail includes sealing and drainage elements so the cladding panels can be lapped and supported at the position of the mounting rail and the panels are mounted without direct fastenings to a wall. Also disclosed is a mounting rail assembly for a flush mounted cladding panel for a building wall, for forming a drained and ventilated cladding system.

19 Claims, 10 Drawing Sheets

CLADDING RAIL, CLADDING FIXING SYSTEM AND METHOD

The invention relates to a cladding rail, a cladding fixing system for cladding in building construction and to a method of installation. The invention is directed particularly but not solely towards a cladding system for cavity wall construction.

BACKGROUND OF INVENTION

Existing fixing of lapped cladding such as weather boards attached to battens rely on positive fixings that are clearly visible to the outside and are attached and supported by the battens forming a cavity. In one respect this type of fixing makes it easier to affix but in turn creates more work and maintenance like for example having to drill holes and cover each hole after fixing. These fixing can include fasteners and clips. Existing fixing system for lapped weatherboards are not able to readily allow for different width weatherboards.

Also some of these types of fixings can easily deteriorate and fail due to weather conditions. Unsightly rust marks are not a good look. This type of fixing can also allow unwanted moisture entry into the cavity and inside the building itself. Current methods do not allow for moisture entry and drainage. Pressure differences from the cladding to the cavity are also created thereby encouraging unwanted stress on the cladding and entry of moisture. Fixing cladding is provided at the top and bottom only of stud framing centres which means that differential movement is also not allowed for. Also unwanted point loading is a problem on such cladding panels which can further shorten the life of the cladding.

Existing flush mounted cladding with panels as used in commercial buildings, enables the designer to achieve clean lines without the exposed fastening type look. Current fixing methods for flush mounting include using a clipping method which supports each cladding panel. These types of clips are not hard wearing nor robust enough for extreme weather events. This clipping method involves installing clips at certain points on the bottom of a panel, creating point loading problems for a cladding panel. Installing so many small clips is also time consuming. There is also no allowance for differential movement which naturally occurs due to temperature differences associated with weather events.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned. Drainage of moisture is a problem in that moisture entry is too easy and is not able to be channelled away horizontally.

OBJECT OF THE INVENTION

It is an object of the invention to provide cladding rail, a cladding fixing system for lapped or flush mounted cladding in building construction and to a method of installation that ameliorates some of the disadvantages and limitations of the known art or at least provide the public with a useful choice.

SUMMARY OF INVENTION

Accordingly in one aspect the invention consists in a mounting rail A mounting rail for mounting a cladding panel in a lapped formation on a wall, the mounting rail includes an elongate body shaped in cross section having a vertical upstanding rear flange adapted to be mountable to a wall, a downwardly extending front flange and a sloping web portion extending from the rear flange to the front flange, the web portion also including a downwardly extending channel portion adapted to slidably receive at least an upper portion of a lower panel and the front flange portion forming an upward facing channel portion adapted to be able to slidably receive a lower portion of an upper panel, wherein the mounting rail includes sealing means and drainage means such that the cladding panels can be lapped and supported at the position of the mounting rail and the panels are mounted without direct fastenings to a wall. and the mounting rails are horizontally mounted to the battens and a bottom of one cladding panel being located in the upper facing channel and a top of another cladding panel being located in the downwardly facing channel whereby a cavity is formed between a back of the panels and the front of the wall to be clad, such that each panel is held without fasteners and any moisture if formed in the cavity can be drained away from the panels by the drainage means, to also cause pressure equalization to minimise stress on the panels.

Preferably, the sealing means is located on at least a portion of a front face of the front flange mounting rail wherein when in use the lower portion of an upper panel abuts the sealing means and forms gaps there between to allow moisture travel downwardly to the drainage means.

Preferably, the drainage means includes at least one aperture located in a base of the upwardly facing channel of the mounting rail, below the sealing means, to form a drainage path there through from a cavity formed behind the panels.

Preferably the downwardly extending channel has a rear leg member which extends downwardly to curve towards a position vertically in line with vertical upstanding rear flange.

Preferably the web portion 25 and channel 35 are oriented at an angle with respect to the vertical and horizontal and wall, thereby ensuring that the panels are also oriented at an angle and the water or moisture is directed away from the wall.

Preferably the upper facing channel includes an upstanding front wall which is sized and oriented to provide support to a recessed slot in the lower edge of the upper panel.

Accordingly in a second aspect the invention consists in a lapped cladding panel system for forming a drained and ventilated cladding system for a wall including a framing having cladding in air barrier material thereon and battens affixed to the air barrier material, the lapped cladding panel system mounting rails and cladding panels, the mounting rail includes an elongate body shaped in cross section having a vertical upstanding rear flange adapted to be mountable to a wall, a downwardly extending front flange and a sloping web portion extending from the rear flange to the front flange, the web portion also including a downwardly extending channel portion adapted to receive at least an upper portion of a lower panel and the front flange portion forming an upward facing channel portion adapted to be able to receive a lower portion of an upper panel, wherein the mounting rail includes sealing means and drainage means such that the cladding panels can be lapped and mounted without fastenings to a wall, the mounting rails are horizontally mounted to the battens and a bottom of one cladding panel being located in the upper facing channel and a top of another cladding panel being located in the downwardly facing channel whereby a cavity is formed between a back of the panels and the front of the wall to be clad, such that each panel is held without fasteners and any moisture if formed in the cavity can be drained away from the panels by the drainage means, to also cause pressure equalization to minimise stress on the panels.

Preferably, the sealing means is located on at least a portion of a front face of the front flange mounting rail wherein when in use the lower portion of an upper panel abuts the sealing means and forms gaps there between to allow moisture travel downwardly to the drainage means.

Preferably, the drainage means includes at least one aperture located in a base of the upwardly facing channel of the mounting rail, below the sealing means, to form a drainage path there through from a cavity formed behind the panels.

Preferably the downwardly extending channel has a rear leg member which extends downwardly to curve towards a position vertically in line with the vertical upstanding rear flange.

Accordingly in a third aspect the invention consists in a method of cladding a wall of a building by lapping a least a portion of the panels on a mounting rail which is mounted onto an outside face of a wall, as disclosed in the first aspect wherein the method includes:

a wall is provided having framing 16 which includes an outer face with an air barrier ready to affix cladding thereto;

attaching battens at a certain spacing (for example 400 mm or 600 mm) in a vertical orientation spanning the framing 16, by attaching the battens 10 by fasteners (eg nails) through to the framing 16;

mount a mounting rail 3 horizontally to line and level (sets up for rest of installation) to span between and over the battens and fasten thereto, by starting at the bottom of the wall;

at least one cladding panel is provided having a along one edge;

starting from the bottom of the wall to be clad, place a first cladding panel on of the bottom rail 3 then tuck another mounting rail 3 on top of the first cladding panel and affix the rail to the framing 16;

then another cladding panel and then rail and so on up the wall.

Accordingly in a fourth aspect the invention consists in a mounting rail assembly for a flush mounted cladding panel for a wall of a building, for forming a drained and ventilated cladding system for a wall including framing having an air barrier material thereon, the flush mounted cladding system including mounting rails for mounting panels thereon, the mounting rail includes an elongate body shaped in cross section having a vertical leg 125 being adapted to be attached to the wall and having an upper throat 128 to allow for the location and support of a lower end of an upper panel thereon by a lower panel portion bead member 123, the mounting rail including a lower downwardly angled or curved leg being shaped having a lower throat 131 to allow an upper portion of a lower panel to be located and supported thereon by an upper panel portion bead member 122 to provide flush mounted panels having a horizontal gap there between with no fastenings on an outer face of the panels.

Preferably the upper panel portion bead member 122 includes a cross sectional shape with flanges 135 & 137*a* located at the top end of and supported below by an upright base web leg 138 wherein one flange 135 is shaped having an upwardly rising angle portion 137 leading to a upright portion 135 adapted to enter the lower throat 131 and abut against a tab 127*a* and the other flange 137*a* with the base leg 138, adapted to cap the top and side of the lower panel and be affixed to the panel by fastening means whereby the fastening means does not protrude to the front of the lower panel, Preferably the lower panel portion bead member 123 includes an L shaped bead member 123 having a hooked shaped base 146 and upright portion 145, whereby the upright portion 145 is adapted to be fastened to the lower portion of the upper panel and hook shaped base 146 in use adapted to be received by the upper throat 128 and by held in place by a hook 126 as provided by the vertical upstanding rear flange 125.

Accordingly in a fifth aspect the invention consists in a flush mounted cladding panel system for forming a drained and ventilated cladding system for a wall including framing having an air barrier material thereon, the flush mounted cladding system including mounting rails for mounting panels thereon, and lower panel portion bead member and an upper panel portion bead member, the mounting rail includes an elongate body shaped in cross section having a vertical leg being adapted to be attached to the wall and allow for the location of a lower end of an upper panel thereon by the lower panel portion bead member 123, the mounting rail including a lower downwardly curved leg being shaped to allow an upper portion of a lower panel to be located thereon by the upper panel portion bead member 122.

Accordingly in a sixth aspect the invention consists in a method of cladding a wall of a building to form a flush mounted cladded wall, wherein the method includes the following steps of:

firstly fasten rails ie the L shaped wall mounted members 121 to an outer surface of the wall abutting by penetrating the framing;

next rest the horizontal leg 146 of the L shaped bead 123 onto the cantilever portion of rail 121, then rotate bead 123 upwardly and drop the horizontal leg 146 of the L shaped bead elongate member 123 into the upper throat space 131 with vertical leg 145 having adhesive outwardly exposed;

attach adhesive and/or tape to the upper ends of the cladding panel;

over & abutting the packer, attach the stepped shaped elongate member 122 using slotted fasteners;

rotate the upper end of the first panel whereby the stepped shaped elongate member 122 into the lower throat space 128 of L shaped wall mounted member 121 until 136 abuts 127;

the clearances between the rails beads flashing and panels means that any panel can be brought to a near vertical orientation with respect to the rail attached to the wall and simply dropped into place;

then rotate and drop the bottom of this same panel whereby the exposed adhesive on the vertical leg 145 of the L shaped bead 123 then abuts, seals and instantly affixes the bottom of the panel into place whereby an end hook abuts downward hook 126 and then when allowed to drop, the underside of L shaped bead 123 rests on top of the cantilever and the hook 151 abuts an end of the cantilever.

BRIEF DESCRIPTION

The invention will now be described, by way of example only, by reference to the accompanying drawings:

FIG. 1 is a cross sectional view of a cladding fixing system for lapped cladding in building construction.

FIG. 2 is a cross sectional view showing how the lapped cladding is installed.

FIG. 3 is a cross section of the mounting rail for the lapped cladding system.

FIG. 4 is a front perspective view of the mounting rail of FIG. 3

FIG. 5 is a rear perspective view of the mounting rail of FIG. 3

FIG. 6 is a cross sectional view of a cladding fixing system for flush mounted cladding in building construction.

FIG. 7 are cross sectional views showing how the mounting rail assembly is installed.

FIG. 8 is a cross sectional view of the assembled mounting rail of FIGS. 6 & 7.

FIG. 9 is a front perspective view of the mounting rail of FIG. 8.

FIG. 10 is a rear perspective view of the mounting rail of FIG. 8

DESCRIPTION OF DRAWINGS

The following description will describe the invention in relation to preferred embodiments of the invention, namely a cladding rail, a cladding fixing system for cladding in building construction and to a method of installation. The invention is in no way limited to these preferred embodiments as they are purely to exemplify the invention only and that possible variations and modifications would be readily apparent without departing from the scope of the invention.

The terms such as for example 'inner' and 'outer', above, 'below', 'top', 'bottom' and 'side' have meanings relating to their use in the industry. Also other terms commonly used in the building and construction industry such as 'boards', 'panels', 'sheets', flanges webs and also a bead flashing can be used interchangeably with out departing from the scope of what is being described. For example though some items for the flush mounting have been described as being a 'rail' or 'bead' or 'flashing' can readily be interchanged as these words have been used to make it easier to differentiate between various elongate extruded members rather than just relating to their strict meanings and/or use. In this specification the terms 'beads' and 'rails' are especially similar in that the both terms cover elongate metal extrusions functioning more so, to support whereas the 'flashing' can function also to weather proof rather than just support.

Lapped Cladding Panel System—FIGS. 1-5

Figure 1:
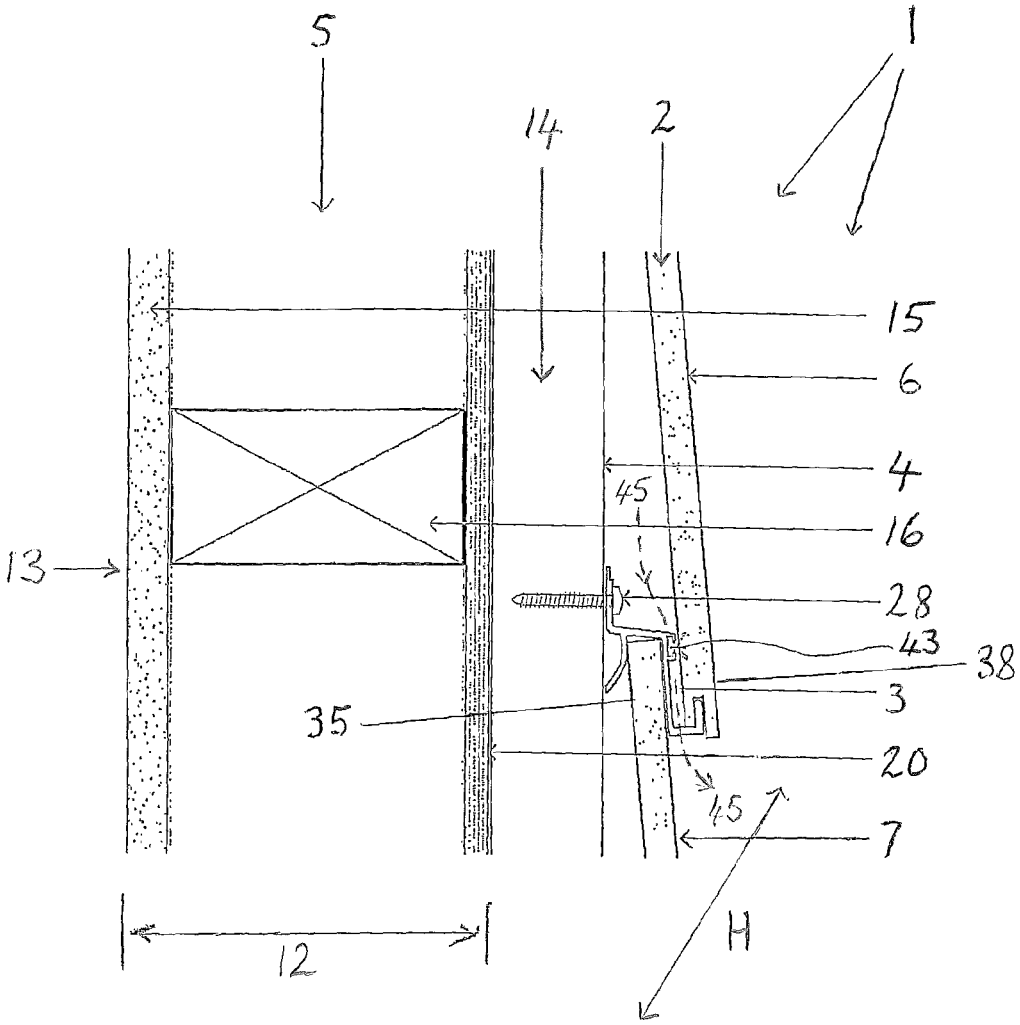
Figure 2:
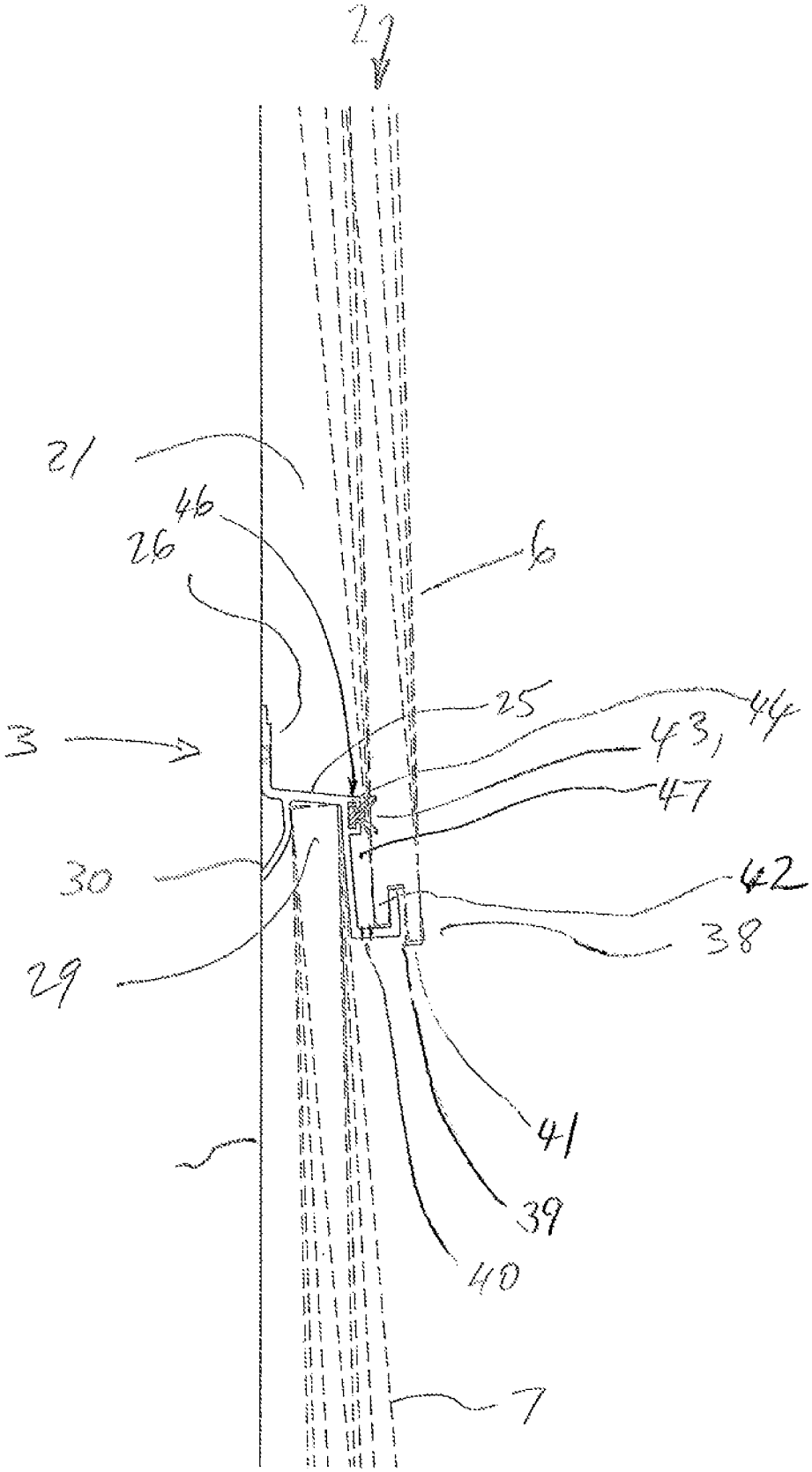

The first embodiment of the invention relates to mounting cladding on a wall as shown in FIGS. 1-5 which show a cladding fixing system 1 for overlapping cladding panels which in this example the cladding panels are in the form of weatherboards supported by at least one mounting rail 3, cavity forming members 4 and a wall or part of a wall 5. The mounting rails 3 support the cladding panels without the requirement for any fixing in the cladding panels to effectively allow the cladding panels to slot and float while in place. This type of mounting according to the present invention allows the panels and rails to never be stressed so if the mounting rail 3 is expanding due to temperature or the panels are expanding due to moisture neither of the mounting rail or panels impinge on the other or restricts its movement. As shown in example, FIGS. 1 & 2 show two panels ie an upper panel 6 and lower panel 7.

The cladding panels in this example are weather boards which are generally planar elongate members with a certain thickness having faces or sides whereby one side is mountable to and supported by the cavity forming members 4. For example the weather boards 6 or 7 can be 200 mm (300, 400, 500, 600 mm)×100 thick like any homogenous flat sheets or panels or composites. The cladding panels have a length extending in a direction into the page as seen in the cross section of FIG. 1. The cavity forming members 4 are affixed to at least one side of the wall of a building. The wall of the building (without the cladding) includes a body having a thickness 12, an inner side 13 facing inside the building and an outer side 14 facing externally of the building. The inner side 13 includes wall lining such as for example plasterboard 15. The wall typically includes internal supporting framing 16 having on one side of the framing, inner wall lining boards 6 such as for example plasterboard facing the inside the building. Framing 16 can comprise for example timber or non timber members such as commonly known as 'stud framing' arranged in a frame-like pattern.

Also typically, an air barrier material 20 can be mounted to the other side of the framing 16 to face in use, outwardly. The cavity forming members 4 can be in the form of elongate members like for example battens 45 mm width×35 mm thick (H3.1) which are vertically positioned in abutment on an outer face of the air barrier 20 and are affixed through the air barrier 20 to the framing 16 of the wall.

As seen in FIG. 1 the weather boards 2 when in use, when supported with the battens 4 together with the thickness dimension of the battens 4 define and form a cavity 21 there between. The battens 4 are affixed minimally in a substantially vertical orientation but importantly must be positively supported by the framing 16. Though the size of battens 4 can be altered 35 mm was selected to give a certain depth cavity behind the cladding panels which is a minimum cavity size as used in Australia. Another reason for 35 mm thick battens 4 is that it means that mounting rails 3 can be fixed directly to the battens 4 without any fastenings penetrating through to the framing behind.

Each mounting rail 3 is adapted to be affixed and support each cladding panel 6 or 7 to the vertical battens 4 and includes an elongate body mounted horizontally across the battens 4. As seen in all the figures but especially in FIGS. 3-5, the mounting rail 3 comprises an elongate body formed from a non timber material such as for example powder coated metal like aluminium. The elongate body has a cross sectional profile of a 'stepped like shape' with an in use, central web portion 25 having an upper rear flange portion 26 and front lower flange portion 27.

Figure 3:
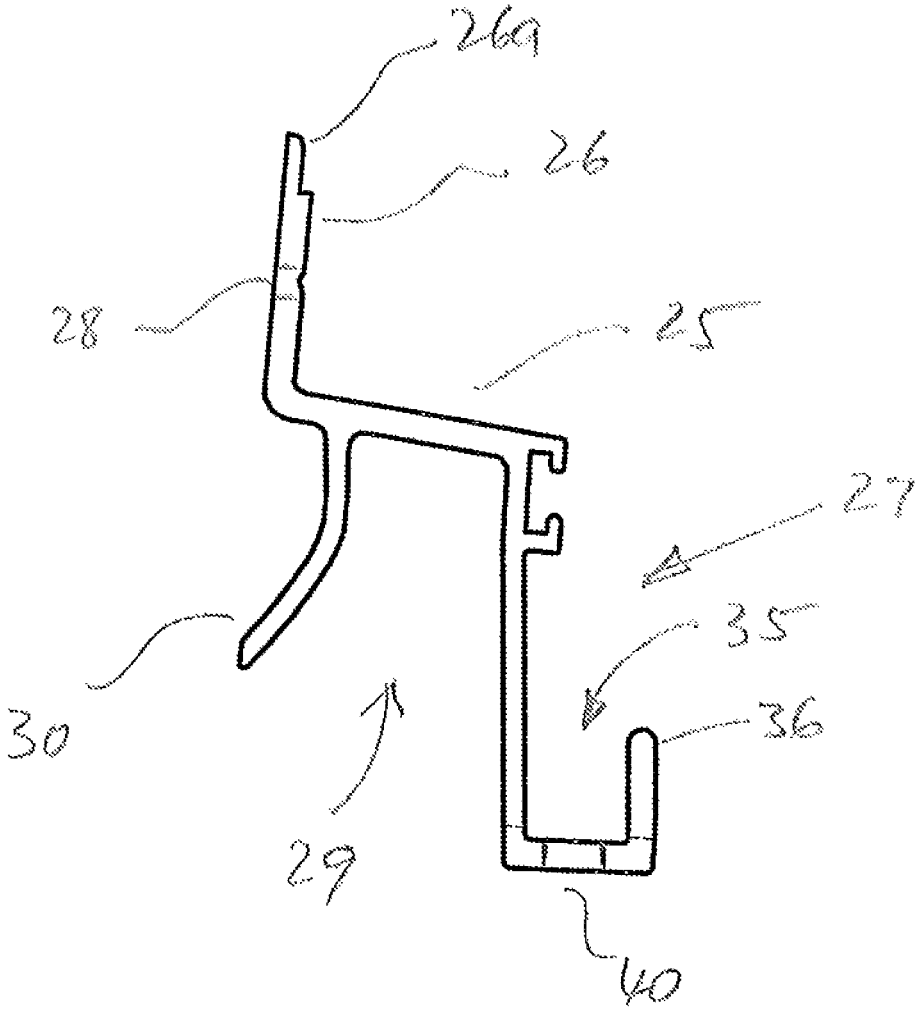
Figure 4:
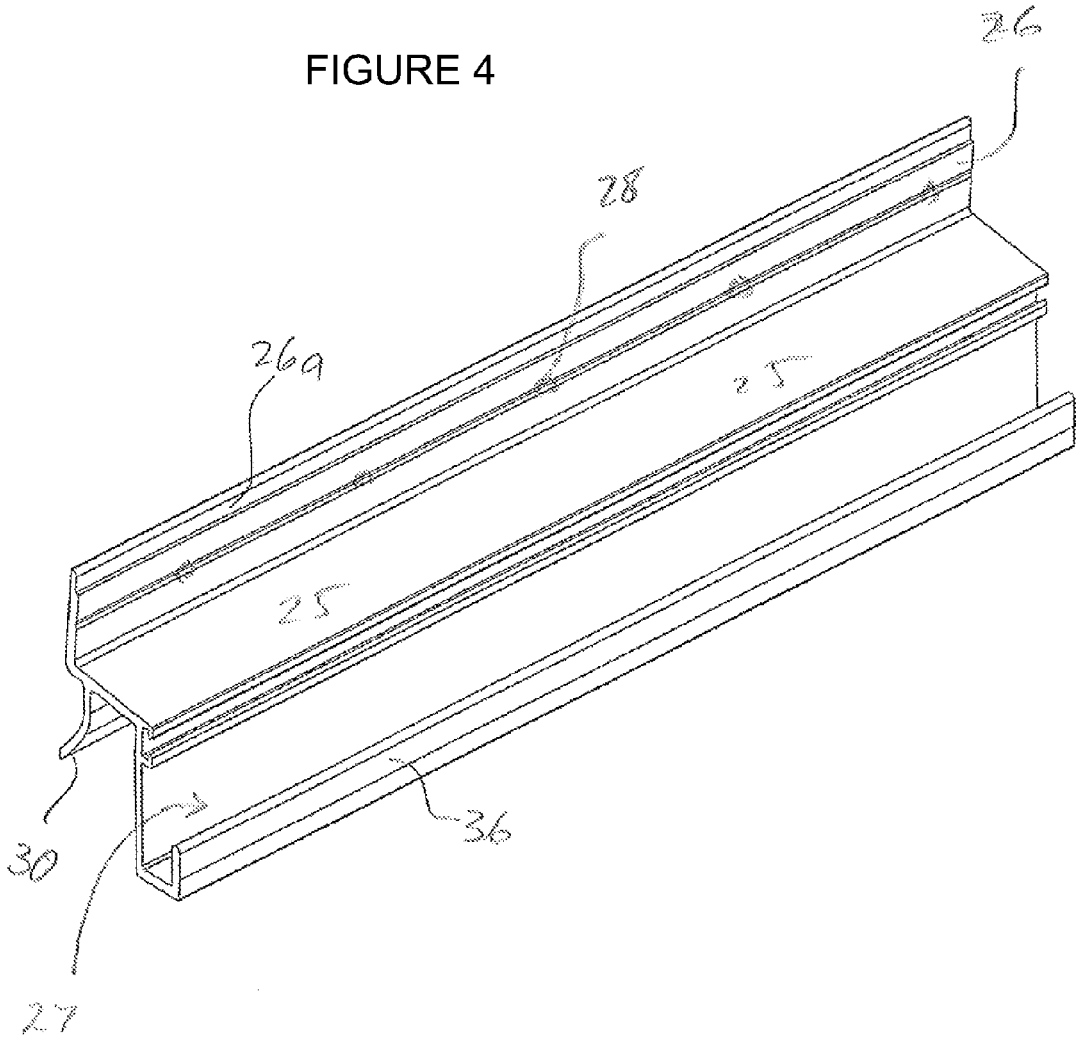
Figure 5:
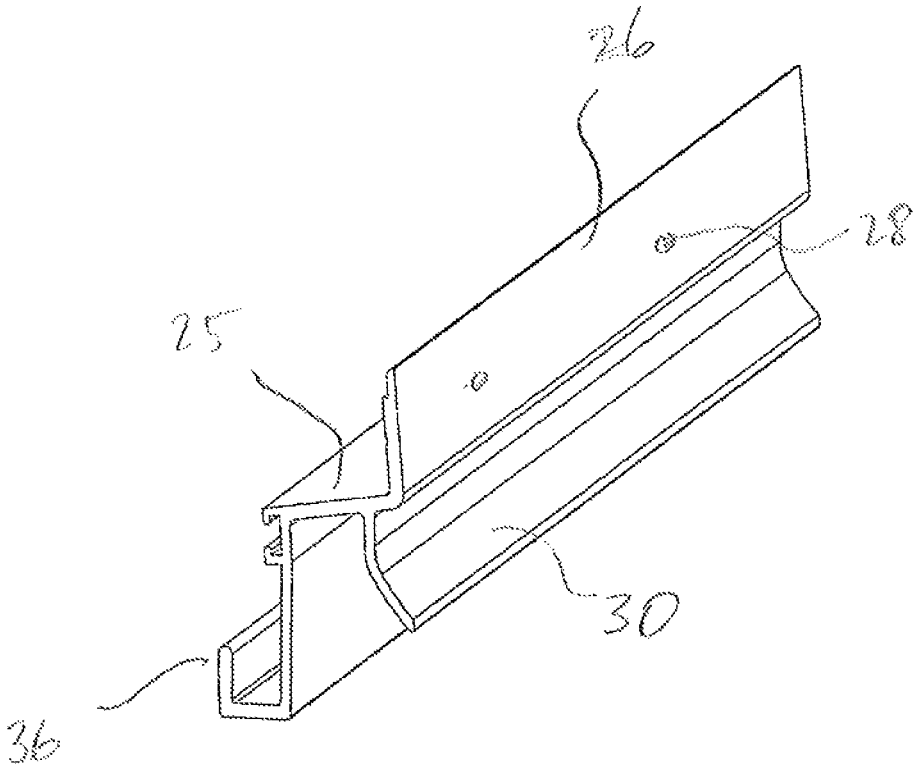

As shown in FIG. 3, in use the upper rear flange portion 26 is substantially vertical in orientation having at least one aperture located adjacent to a batten 4 to allow fastening means 28 to be inserted there through. As shown in FIG. 1 fastening means 28 can include a screw-like fastener (eg 32 mm×10 g pan head square driven SS 304) being oriented in a direction at right angles to the length plane of each cladding panel and mounting rail 3 and extending or penetrating into a batten without meeting or penetrating the air barrier material 20. The mounting rails 3 can be fixed to the 35 mm battens 4 at 600 mm centres for domestic dwellings or 400 mm for high wind zones.

As shown the rear flange portion 26 has thickness **26*a*** reduced at an in use upper end which can assist in providing strengthening.

Central web portion 25 is shaped having an upper surface, angled slope to lean forward towards the outer side 14 of the wall to allow any moisture to drain away from the inside 13 of the building or away from the cavity 21. A lower surface of the central web portion 25 has a downwardly facing open channel portion 29 formed including a rear flange leg member 30 and the front flange leg member 27 forming the other front portion of the channel. The downwardly open channel 29 is sized and dimensioned to easily receive a top portion 35 of one end of a cladding panel. Rear flange leg member 30 is shaped having a down vertical base extending downward parallel in the same direction as the front flange leg member 27 and then curves away from front flange leg member 27 to meet an outer surface of a batten 4 which means that the channel portion 29 has a wider entrance than further inside the channel. The upper rear flange member 26 functions to both form a border to an upper channel and more easily allow the top of a panel to be rotated in and as seen the top edge of any panel does not need to be flush with an under surface of the central web portion 25 within the downwardly open channel portion 29.

The rear flange member 26 can be thought of as a tongue like member whereby one of its surfaces within the channel portion 29 shape has as many facets or bevels to allow varying width cladding panels (eg 200 mm to 600 mm) to be guided into place and be abutted.

The lower front flange leg member 27 extends downwardly in a direction opposite to the direction of the rear flange leg member 26 to form another channel in the shape of an upwardly facing channel 35 comprising square shaped hook with an upright front flange 36 which is of less height than the rear of the upwardly facing channel 35. The upwardly facing channel 35 is sized and adapted to receive a portion of a lower end 38 of a cladding panel which has a slot 39. Cladding panel slot 39 extends along at least part of the length of at least one edge of the cladding panel 6 or 7. Upwardly facing channel 35 of the mounting rail 3 also has at least one aperture 40 located when the rail is in place, between battens 4 to allow any moisture within the cavity 21 to be drained away. Lower end 38 is designed to be wider that the thickness of the hook 36 to allow for movement during use eg temperature and building movement and also during installation.

Cladding panel slot 39 as shown in the FIGS. 1-3 is formed as a recessed slot ie the slot is covered by a front portion of a panel as an overhang portion 41 such that there is a recess portion 42 behind the overhang portion 41. Such an overhang portion 42 also allows for moisture or water to not be able to be forced upwards into the slot and is instead forced to drip off. Upright front flange is sized and oriented to be slidably received by the panel slot 39 to cause the front overhang portion 41 to extend below the base of the channel 35.

As seen in FIG. 2 there is a sealing means 43 in the form of a gasket member which functions to provide anti-rattling and frictional seal for the cladding panels with slot 39. Gasket 43 comprises an elongate flexible rubber like member which is attached to an outer surface of the front flange member 27 of the rail 3. The attachment is provided by a re-entrant slot 44 which is designed and adapted to hold a base portion of the gasket 43. Gasket 43 is designed to seal and hold and support each panel along at least most of its length. To allow for moisture and equalization of air pressures in the cavity 21 and outside of the cavity 21, the gasket only extends at selected portions (eg end portions) of the distance between battens 4 thereby providing a wide slotted aperture 46 (see FIG. 2—but is difficult to see as it is a slot directed into the page).

The slotted aperture 46 and aperture 40 in the channel together form an open flow path or labyrinth flow path 45 to allow any moisture and air, if formed in the cavity 21 to drain or ventilate (to pressure equalize) as sloped by central web portion 25 forwardly towards the back of each cladding panel to then travel downwards through the slotted aperture 46 (not easy to see in the cross sectional FIGS. 1-3) between gaskets 43 to into a gap 47 (see FIG. 2) formed between a lower portion of the rear of the cladding panels 6 & 7 and down and out through rail aperture 40. Rail aperture 40 is located in the base of the channel 35. The labyrinth flow path 45 allows pressure equalization of the system so that the air barrier material 20 at the back takes the air pressure not the cladding panels or the rails 3.

The distances, dimensions, size and shapes between parts or components of any of the rail mounting assembly and the flashing and panels are specifically determined to allow easy installation and yet provide allowance for movement in multiple directions. This aspect of distances, dimensions, size and shape is especially designed to allow each panel to be rotated minimally at a very shallow angle where access for scaffolding is tight in front of the wall.

The drainage slots or apertures 40 are provided for drainage and are designed to what ever is required such as to 'E2 capacity' which is 1000 square mm per meter so the number of slots or apertures and their sized can be calculated accordingly. Gasket 43 is notched or spaced to provide a slot 46 there between to the equivalent size or area of the drainage slot/aperture 40 of the rail 3 and is offset from the drainage aperture 40 so we get a better drainage system so that if one gets water or moisture therein the cavity, it is designed to track through a labyrinth to exit and it means that water can not be blown back up directly through the aperture 40 and into the cavity 21.

The other purpose of the slots 46 and apertures 40 is achieving pressure equalization which means that the pressure inside the cavity is at the same pressure as the outside and therefore water cannot be transferred due to pressure differential. As shown in FIG. 2 the dotted lines show how the sizes of the channels and their orientation are designed to allow one to manoeuvre each panel vertically by tilting about a top edge or bottom edge into place without requiring much space in front of the wall.

Vertically, the lapped cladding boards can have typical end flashings. At the base of any wall the same cladding system can be used but with some spacing member TS 46 whereas at the top of any such wall, a different profile would be required like for example TS 42 or even a typical top flashing as commonly used. As shown in FIGS. 1 and 2 the mounting rail is shaped such that the web portion 25 and upwardly facing channel 35 are at an angle or lean to the vertical and horizontal, to assist in the lapping of the cladding panels which are also then at a lean or angle to the wall and the vertical and assist in drainage by pushing the water out from the wall.

Method of Installing Lapped Cladding

There is also included a method installing the cladding fixing system as described above and assuming that there is an upper panel and lower panel, as shown in FIG. 2:

a wall is provided having framing 16 which includes an outer face ready to affix cladding;

form the cavity by attaching battens 4 at a certain spacing (for example 400 mm or 600 mm) in a vertical orientation spanning the framing 16, by attaching the battens 4 by fasteners (eg nails) through to the framing 16;

mount a mounting rail 3 horizontally to line and level (sets up for rest of installation) to span between and over the battens 4 and fasten thereto, by starting at the bottom of the wall;

at least one cladding panel is provided;

starting from the bottom of the wall to be clad, place a first cladding panel on of the bottom rail 3 then tuck another mounting rail 3 on top of the first cladding panel and affix the rail to the framing 16;

then another cladding panel and then rail and so on up the wall and finishing the top of the wall with a mounting rail over the topmost cladding panel.

There is no need to check line and level of the installed cladding if it has been done correctly with the first rail.

As part of this installation process there are various accessories that can be used such as flashings which can be proprietary predesigned extruded flashings which incorporated two 5 mm legs that act as a capillary groove and would prevent water tracking across to the fixings 28 which is on the further side away from water ingress.

PARTS LISTING FOR LAPPED CLADDING SYSTEM

1. cladding fixing system
2. weatherboards

3. mounting rail
4. Cavity framing members—battens
5. wall
6. upper panel or cladding panel or weather board
7. lower panel or cladding panel or weather board
8.
9.
10.
11.
12. wall thickness
13. inner side of wall 5
14. outer side of wall 5
15. wall lining eg plasterboard
16. wall framing
17.
18.
19.
20. air barrier material
21. cavity
22.
23.
24.
25. web portion of the mounting rail member 3
26. rear upper flange portion of the mounting rail member 3, 26*a* reduce thickness of flange
27. front lower flange portion of the mounting rail member 3
28. fastening means
29. downwardly facing open channel portion
30. rear leg flange portion
31.
32.
33.
34.
35. upwardly facing channel
36. upright front flange
37.
38. lower end of a cladding panel
39. cladding panel slot
40. channel 35 drainage aperture
41. cladding panel overhang portion
42. cladding panel recess portion
43. gasket member for mounting rail 3
44. re-entrant slot in mounting rail
45. drainage flow path
46. slot or gap between ends of the gasket and between the inside face of the panel and the mounting rail
47. gap or space below the gasket 43 and gap 46, and between the inside face of the panel and mounting rail Flush Mounted Cladding Panels—FIGS. 6-10

Using as much of the previous terminology and orientations as before, as shown in FIGS. 6-10 there is shown a flush mounted cladding panel system 100. This flush mounted cladding panel system 100 is designed for forming a flush mounted panel system whereby the outer face of the finished wall is substantially flush but some allowance is made to provide a horizontal gap G between panels to enable horizontal drainage there from.

Figure 6:
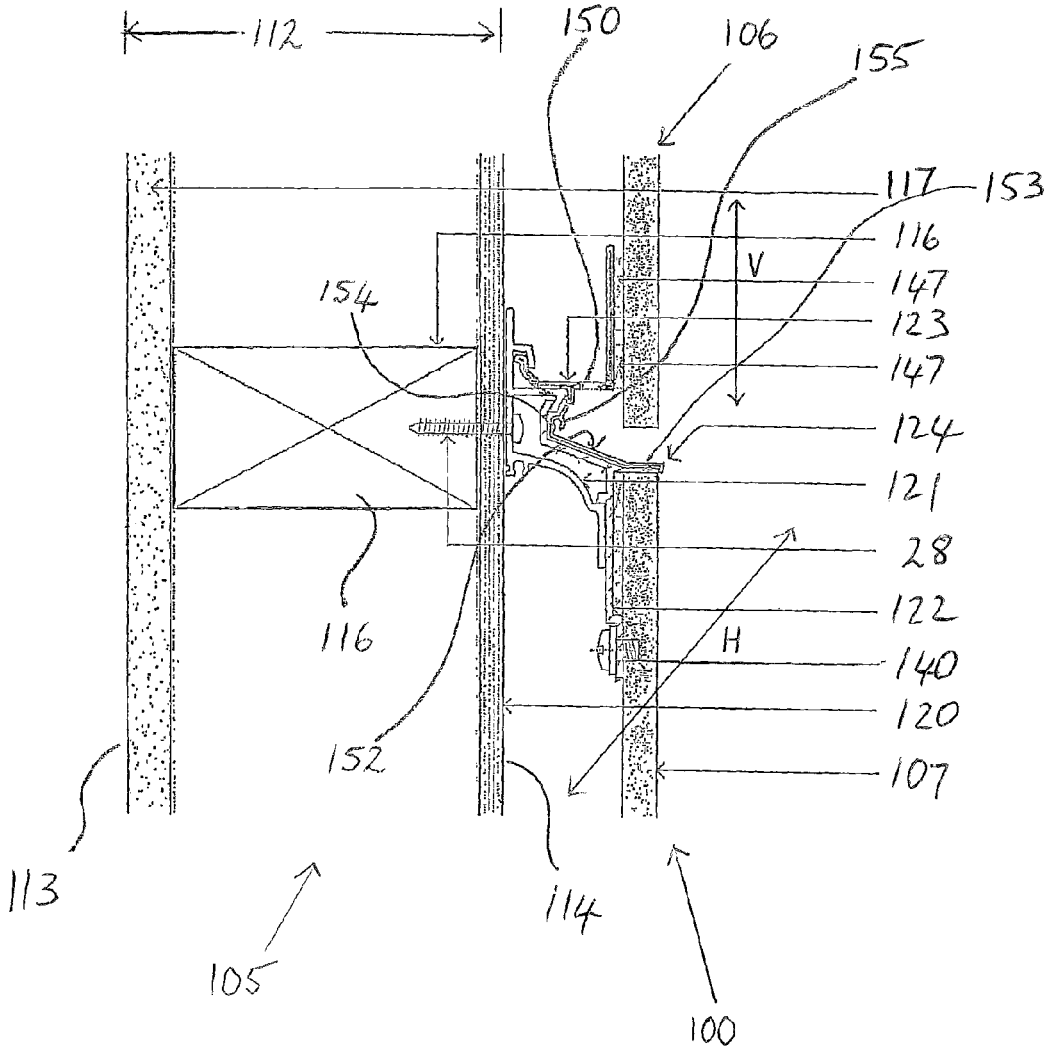
Figure 7:
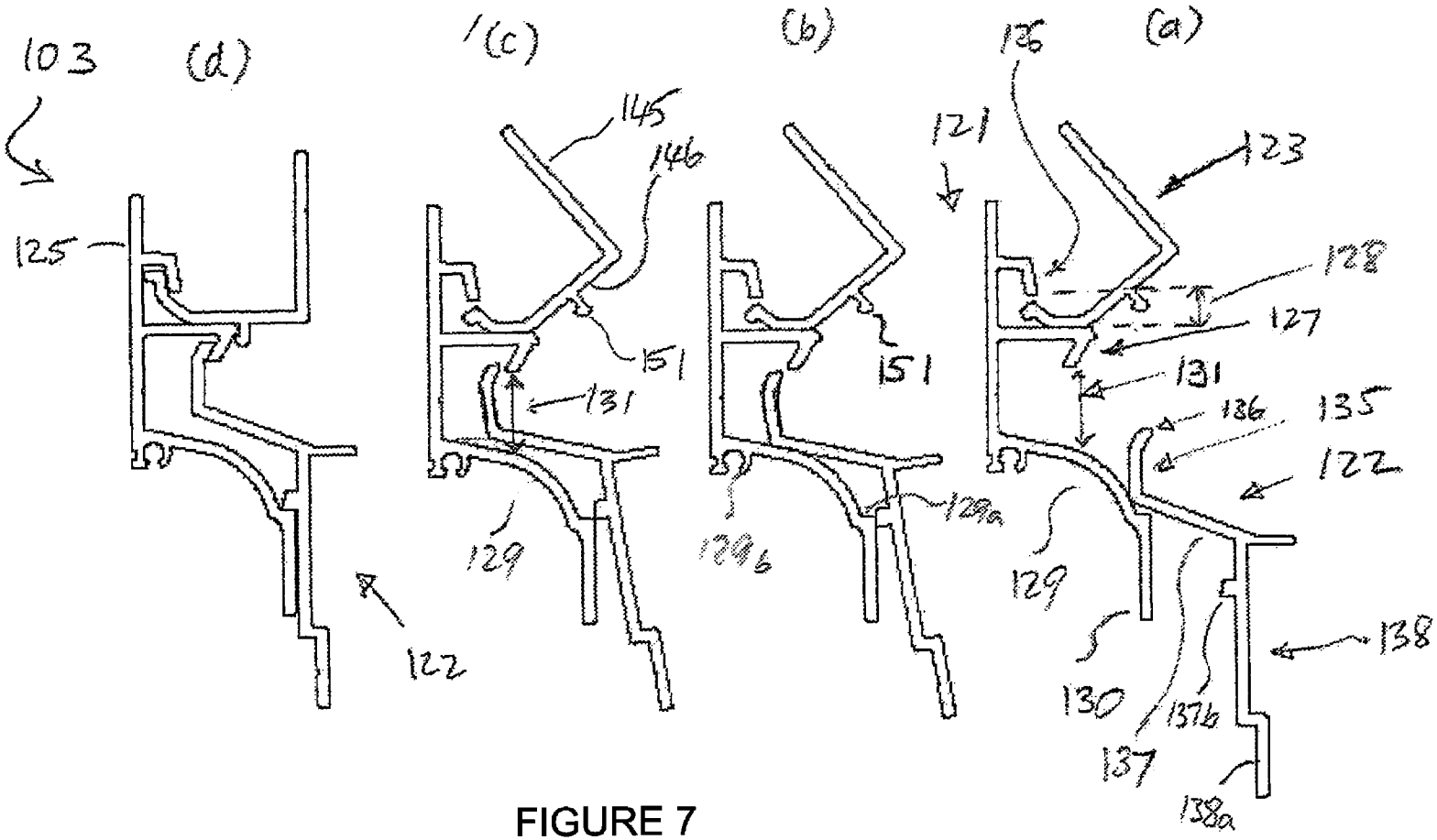

The second embodiment of the invention for mounting cladding on a wall relates to FIGS. 6-10 which show a cladding fixing system 100 for flush mounted cladding panels which in this example the cladding panels are in the form of panels which are affixed and supported by at least one mounting rail assembly 103, which in turn is fixable to a wall 105 of a building. As shown in example, FIGS. 6 & 7 show two cladding panels ie an upper panel 106 and lower panel 107.

The wall of the building includes a body having a thickness 112, an inner side 113 facing inside the building and an outer side 114 facing externally of the building. The wall typically includes internal supporting framing 116 having on one side of the framing, inner wall lining boards 117 such as for example plasterboard facing the inside the building. Framing 116 can comprise for example timber or non timber members like for example studs arranged in a frame like pattern.

Also typically, an air barrier material 120 can be mounted to the other side (the outside 14) of the framing 116 to face in use, outwardly. No cavity is required so that the mounting rail assembly 103 is adapted to be affixed to the outside face of the wall or air barrier material 120.

Mounting rail assembly 103 includes four elongate functionally related components (see FIG. 8) comprising an wall mounted rail 121, and an upper panel portion bead member 122, a lower panel portion bead member 123. The flush mounted cladding panel system 100 also includes an angled elongate flashing member 124, as shown in FIG. 6.

Mounting rail member 121 can be loosely described as being almost L shaped and is adapted to be mounted by fasteners 28 against an outer face of the air barrier material 120 on the wall of the building, and is mounted through to the internal wall framing 116 and slidably interlocked with a portion of the upper panel portion bead member 122 which causes the cladding panels to be spaced from the air barrier material 120. Rail member 121 comprises in use an upright leg 125 having a downwardly facing almost square shaped hook 126 extending there from and on the side of leg 125 facing way from the wall. Below hook 126, there is a cantilever portion 127 which together form a space or upper throat 128 there between.

Figure 8:
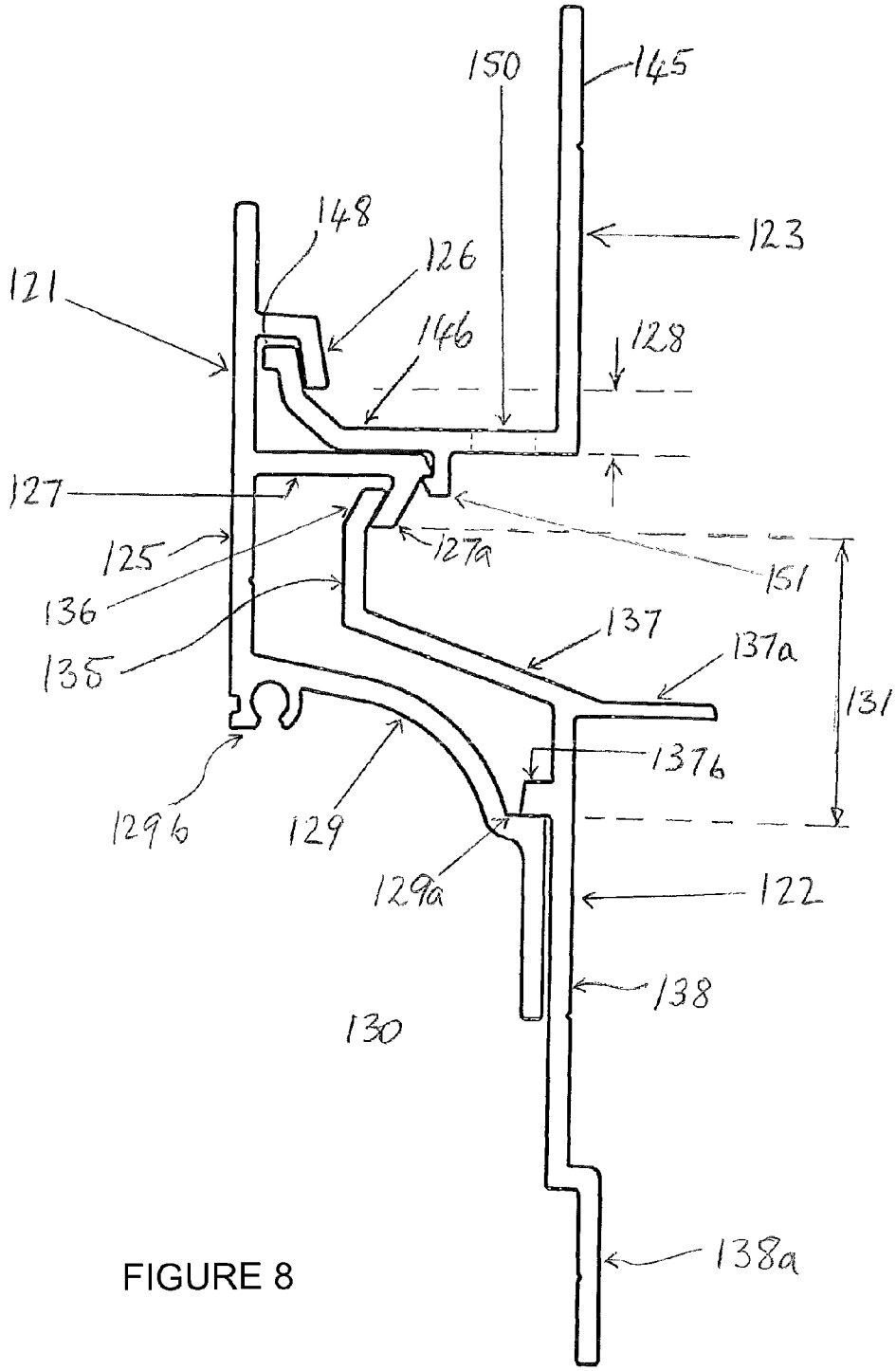
Figure 9:
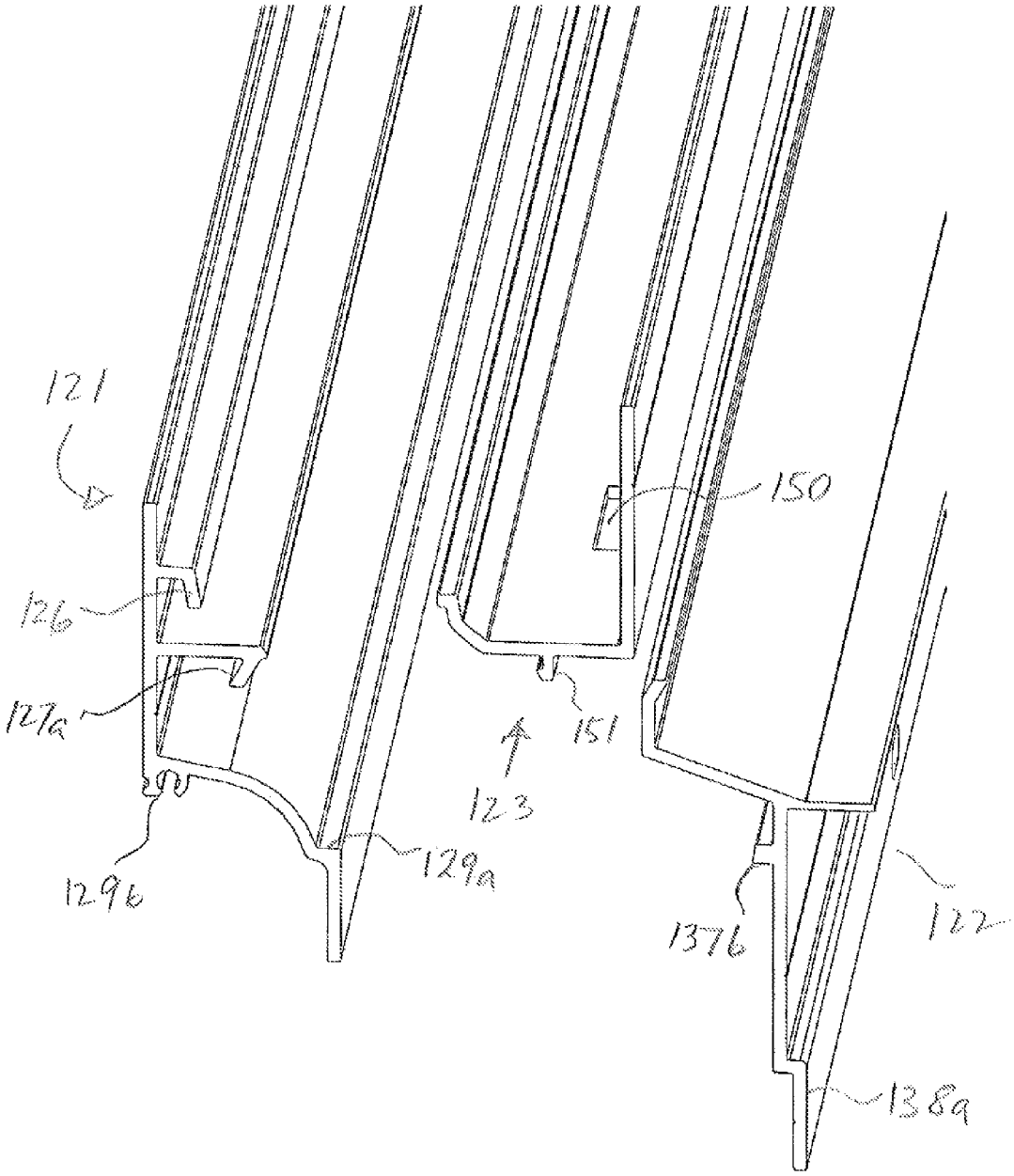
Figure 10:
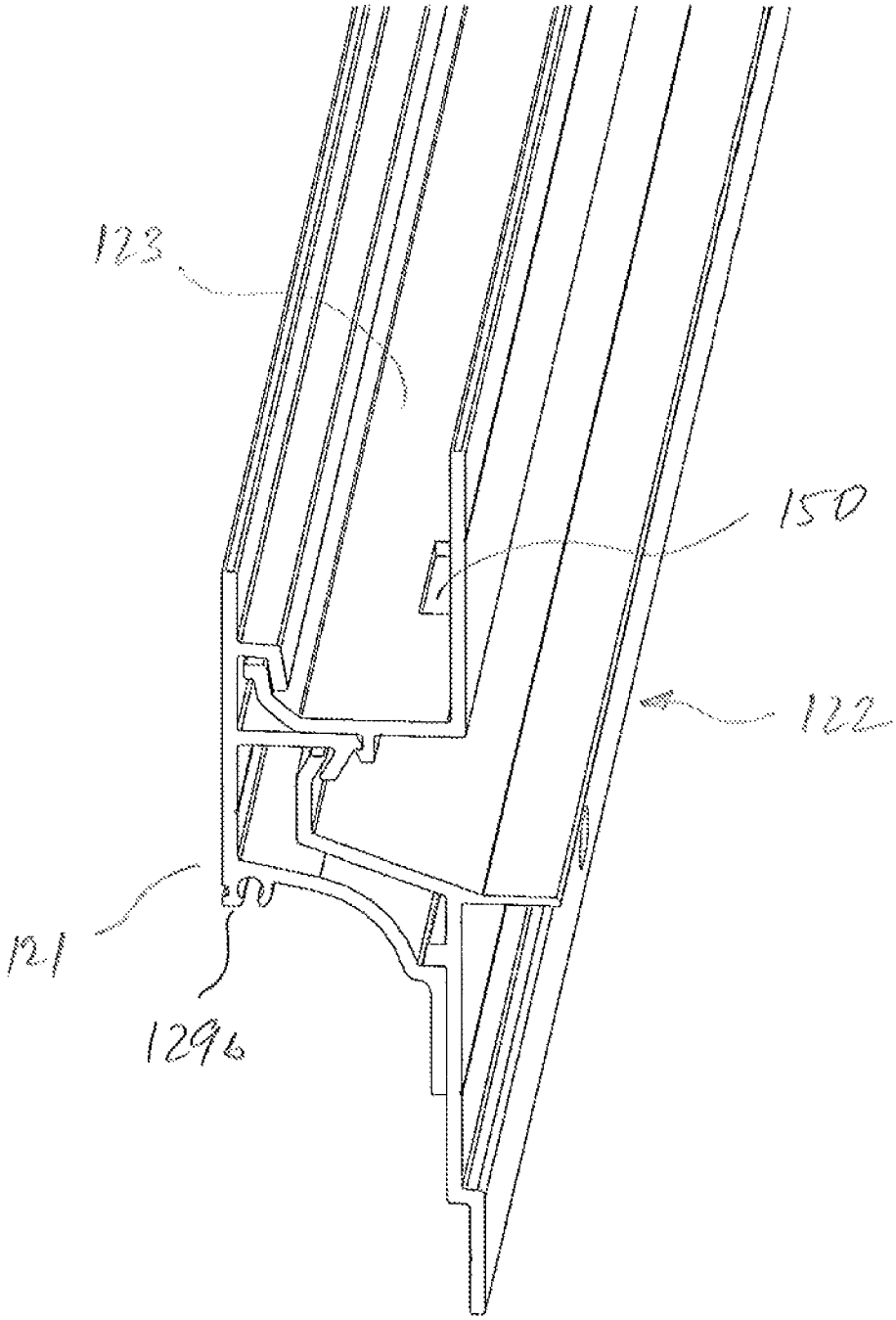

Cantilever portion 127 also includes downwardly extending hook 127*a* angle inwards towards the wall. Located and extending from a base of the upright leg 125, is an angled or curved horizontal arm 129 (functions to allow sliding of the upper panel portion bead member 122 on top when installing the panels) of the L shape 121 which is curved downwardly, ending in a downwardly extending vertical arm 130. Again there is a space or lower throat 131 between cantilever portion 127 and angle or curved horizontal arm 129. When fitted or assembled an outer face of the downward arm 130 abuts a portion of upper panel portion bead member 122. Curved arm 129 has a seat 129*a* located before the vertical arm 130, to rest a tab 137*a* of upper panel portion bead member 122 thereon. Mounting rail member has an end flashing fixing means 129*b* in the form of a three quarter circular means as shown in FIGS. 8-10. This end flashing fixing means 129*b* is located underneath, at the junction of the upright leg 125 and angled or curved horizontal arm 129

Upper panel portion bead member 122 having stepped portions for fixing the top of each panel to the L-shaped mounting rail member 121, has flange portions 135, 136, 137, 137*a* & 137*b* supported and protruding in opposite directions from a vertical web base 138. One flange portion includes an upwardly angled portion 137, angled towards the wall leading to an upright portion 135 with an end part 136 being angled back towards the cladding panels as shown in FIG. 8. On the other side of the web base portion 138 there flange portion 137*a* formed as a horizontal oriented portion pointing out away from the wall.

Fastening means 140 is used to fasten the lower end of the vertical web base 138 to an upper end of a lower panel. Flange 137*b* extends outwardly from the vertical base 138 to point towards the wall and is located below angled portion 137 and serves to when the bead member 122 is being inserted into the lower throat 131 to finally sit on top of ledge 129*a* of the rail member 121.

The vertical web 38 when assembled, and in use with panels, abuts an outer side of the downward arm 130 on one side of the leg 121 and on an outward side, to fixing means 139 eg adhesive (see FIG. 6) abutting a top end and side of a panel 107.

The upright portion 135 and end part 136 are also designed to substantially close off the upper throat and cavity below where fastening means 140 are located. This means that the fasteners 140 are protected from wind driven rain or drainage water that can come through from above the apertures 150 of lower panel portion bead member 123.

A lowest end of the leg 138 can be stepped inwardly further towards the inside face of a cladding panel to form a recess 138*a*, to directly abut the inside side of the cladding panel and be fastened by a fastening means 140 into the recess 138*a* and into the cladding panel. This fastening 140 is selected and attached so as to not protrude through to the front of the cladding panel. Also this recess 138*a* is slotted in the horizontal direction ie directly into the page of FIG. 1 to allow for differential movement of the cladding panel and or mounting rail assembly. Upper panel portion bead member 122 also has a cantilever flange member 137*a* located parallel and below cantilever 127 which functions to cap the top of a panel as shown in FIG. 6.

Upper panel portion bead member 122 is pre fixed by fixing means such as for example, adhesive to the top of each panel by adhesive and the fastening means 140 provides a mechanical back up. The fastening means 140 are fitted to slotted holes and the fasteners which can be screws can have a nylon washer to assist with the differential movement between the cladding panels and rail. The cladding panels move with moisture and the rail 121 moves with temperature. The length of rail 121 is calculated for the differential movement possible between the adhesive and tape 139 and cladding panel, for differential movement.

For the other component of the mounting rail assembly ie the lower panel portion bead member 123, includes an upright vertical leg 145 and horizontal leg 146 so that in use the vertical leg 145 is attached to the back of the panel by fastening means such as for example, a tack adhesive and tape (eg 12×3 mm) 147. The horizontal leg 146 has an upturned end edge 148 which is when being assembled, rotatably slotted into the throat 128 and has at least one aperture 150 to allow moisture in a cavity behind an upper panel to exit. Horizontal leg 146 also has a downwardly angled tab hook 151 which functions when a lower end of a panel with lower panel portion bead member 123, is being inserted to abut the hook 127 of the rail member 121 whereby the end edge 148 is inserted into the throat 148.

For the flashing member 124 (as seen in FIG. 6) this member is generally placed after the cladding panels 106 & 107 (and any other panels) have been fitted to the wall with components 121, 122 & 123 and is fitted in a gap between the flush mounted panels. Flashing member 124 comprises an angled portion 152 in use to rest on an upper surface of upper panel portion bead member 122. Joined to the angle portion 152 there is a horizontal portion 153 which in use rests on an upper edge of a lower panel to flash the edge and prevent moisture dropping downward behind the lower panel. For example flashing member 124 can be aluminium.

Flashing member 124 has an upright portion 154 angled away from the wall which in use abuts a similar shape in the end part 136 of the upper panel portion bead member 122. Upright portion 154 also has a downwardly shaped three quarter circular hook member 155 which can be used for fixing end flashings.

As the rails, beads and flashing on extend in the horizontal plane of the wall each cladding panel is only restricted in its movement in one direction but the rails 121 and bead member 122 and 123 can move vertically V as shown in FIG. 6. However, the whole mounting system is designed to move in two directions ie side ways or horizontally H or vertically V. So there is differential movement between each cladding panel and its supporting rails by means of adhesive fixing, and then we have differential movement between the rails on the panels and the panels themselves, and the building by means of the slide fit between the beads and the fixing rails onto the building. The distances between parts of any of the rail mounting assembly and the flashing and panels are specifically determined to allow easy installation and yet provide allowance for movement in many directions.

Vertically, the flush mounted cladding boards can have typical end flashings. At the base and top of any wall the same cladding system can be used. As shown in FIG. 7 a lower panel having an upper panel portion bead member 122 attached or affixed thereto, is slid over curved or angled 126 to then be tip into the lower throat and lie behind the cantilever 127. Also an upper panel having lower panel portion bead member 123 attached or affixed thereon, is firstly slid in over the top of cantilever 127 and then tilted in under downwardly facing square shaped hook 126.

Method of installation for the flush mounted cladding as shown in FIGS. 6-10 This assumes having an upper panel and a lower panel whereby in summary the rails are first put up followed by the panels. The rail includes a pre-fitted lower panel portion bead member 123 which is attachable to the panel when each cladding panel is rotated into position.

firstly fasten mounting rails 121 to an outer surface of the wall abutting or the air barrier material 120 by penetrating the framing 116;

next rest the horizontal leg 146 of the lower panel portion bead member 123 onto the cantilever portion of rail 121, then rotate lower panel portion bead member 123 upwardly and drop the horizontal leg 146 of the lower panel portion bead member 123 into the upper throat space 131 with vertical leg 145 having adhesive outwardly exposed;

attach adhesive and/or tape to the upper ends of the cladding panel;

over & abutting the packer, attach the upper panel portion bead member 122 using slotted fasteners;

rotate the upper end of the first panel whereby the upper panel portion bead member 122 into the lower throat space 128 of L shaped wall mounted member 121 until 136 abuts 127; the clearances between the rails beads flashing and panels means that any panel can be brought to a near vertical orientation with respect to the rail attached to the wall and simply dropped into place. This is because there is a gap between a scaffold (not shown) used to erect the cladding panels, and the mounting assembly on the wall. For example the gap can be 150 mm which is a minimum required to need to put up safety rails for the installers which would suit a panel of say 1200 mm wide (or depth with respect to the vertical). If the panel was to be 1800 mm wide then the gap would have to increase to 220 mm whereupon a safety rail across the face of the scaffold would be required.

then rotate and drop the bottom of this same panel whereby the exposed adhesive on the vertical leg 145 of the lower panel portion bead member 123 then abuts, seals and instantly affixes the bottom of the panel into place whereby an end hook abuts downward hook 126 and then when allowed to drop, the underside of lower panel portion bead member 123 rests on top of the cantilever and the hook 151 abuts an end of the cantilever.

The method is repeated by attaching beads to each rail and flashing to any upper edge of a panel and then rotating upper end of a panel dropping into place and finally allowing the adhesive about the lower end of the panel. Finally after panel in place insert flashing between panels.

The steps of the method are not in strict order and can altered such as by applying the adhesive either before installing the L-shaped bead member at the bottom of each panel before any of the above steps or immediately before rotating and dropping the lower end of the panel into place. Also the packer and upper panel portion bead member 122 similarly can be attached anytime but needs to be placed at least before the upper end of the panel is rotated into position. As another option the panels can be machined on site or off side to fit between the rails.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

PARTS LIST FOR FLUSH MOUNTED CLADDING SYSTEM

100. flush mounted cladding system
101. cladding panels
102.
103. mounting rail assembly
104.
105. wall
106. upper cladding panel
107. lower cladding panel
108.
109.
110.
111.
112. wall thickness
113. wall inner side
114. wall outer side
115.
116. wall framing
117. wall lining—plasterboard
118.
119.
120. air barrier material
121. mounted rail (MR)
122. upper panel portion bead member (UPPBM)
123. lower panel portion bead member (LPPBM)
124. elongate flashing member
125. (MR)—upright member
126. (MR)—downwardly facing square shaped hook
127. (MR)—cantilever portion
128. (MR)—upper throat
129. (MR)—angled or curved horizontal arm—129*a* ledge, 129*b* end flashing fixing means
130. (MR)—vertical arm
131. (MR)—lower throat
132.
133.
134.
135. (UPPBM)—upright portion
136. (UPPBM)—end part, 136*a*
137. (UPPBM)—central portion, 137*a*—cantilever ledge, 137*b*—protrusion member
138. (UPPBM)—vertical web leg
139. (UPPBM)—fastening means
140. (UPPBM)—fastening means
141.
142.
143.
144.
145. (LPPBM)—vertical leg
146. (LPPBM)—horizontal leg
147. (LPPBM)—fastening means ie adhesive and tape
148. (LPPBM)—end edge
149.
150. (LPPBM)—aperture
151. (LPPBM)—tab hook
152. (FM)—angled portion
153. (FM)—horizontal portion
154. (FM)—upright portion
155. (FM)—end flashing means as circular hook member Advantages a) Able to provide drainage
b) Simple installation
c) Lapped cladding not needing direct fastening there through
d) Lapped cladding forms cavity there behind
e) Lapped cladding is captive between two horizontal rails 3
f) Captive cladding allows for differential movement between panels and rail so panels and rails are never stressed.
g) No point loading but continuous support for panels
h) Pressure equalization between cavity and outside.
i) Mounting can be started from the bottom
j) Flush cladding having hidden fastening
k) Flush cladding not requiring cavity
l) Flush cladding allows low angle installation
m) Equalized pressure between cavity and cladding
n) Rails allowed to thermally expand and contract
o) Mounting is rapid
p) Modest cost of manufacture
q) Cladding not under pressure
r) Able to accommodate differential movement
s) Able to provide continuous support for cladding
t) Able to fix lapped cladding and flush mounted cladding
u) Lapped system able to cope with different width weatherboards Variations Throughout the description of this specification, the word "comprise" and variations of that word such as "comprising" and "comprises", are not intended to exclude other additives, components, integers or steps. It will also be understood that where a product, method or process as herein described or claimed and that is sold incomplete, as individual components, or as a "kit of Parts", that such exploitation will fall within the ambit of the invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described. As shown in the drawings various features of the mounting rails and components are described in reference to the cross sections, bearing in mind that the mounting rails and components have an extent either continuously or in spaced amounts into the page so that they can be said to elongate or not.

The lapped cladding mounting system is able to copy with different width weatherboards. This can mean that the spacing of the mounting rail can be moved up or down to suit. Various other extrusions of different profiles can be used with the mounting rails of both embodiments of the invention. For example for the lapped cladding mounting system, the follows types of flashings as referenced by codes TS42 (for top of the wall), TS43 (for external corner), TS44 (for another external corner), TS45 (for internal corner) and TS46 (for the bottom of a wall) represent different flashings for different situations and locations on a wall. Also other types of flashings or possible some of those just referenced, can also be used with the flush mounted cladding system as well.

What I claim is:

1. A mounting rail assembly for a flush mounted cladding panel for a wall of a building, for forming a drained and ventilated cladding system for a wall including framing having an air barrier material thereon, the mounting rail assembly comprising:

continuous mounting rails for mounting panels thereon, each mounting rail having a length sufficient to be continuous across plural mounted panels, wherein each mounting rail includes an elongate body shaped in cross section having a vertical leg (125) adapted to be attached to the wall and having an upper throat (128) to allow for the location and support of a lower end of an upper panel thereon by a lower panel portion bead member (123), each mounting rail further including a lower downwardly angled or curved leg being shaped having a lower throat (131) to allow an upper portion of a lower panel to be located and supported thereon by an upper panel portion bead member (122) to provide flush mounted panels having a horizontal gap there between with no fastening on an outer face of the panels, and wherein the mounting rail assembly mounts the panels oriented in a vertical plane, the upper and lower throats are elongate shaped spaces with a mouth at a front opening in a horizontal plane whereby the lower panel bead member and the upper panel bead member each cantilever within the respective upper and lower throats to be supported therefrom and thereby support the panels in the vertical plane.

2. The mounting rail assembly of claim 1 wherein the upper panel portion bead member (122) includes a cross sectional shape with flanges (135 & 137*a*) located at the top end of and supported below by an upright base web leg (138) wherein one flange (135) is shaped having an upwardly rising angle portion 137 leading to an upright portion (135) adapted to enter the lower throat (131) and abut against a tab (127*a*) and the other flange (137*a*) with the base leg (138), adapted to cap the top and side of the lower panel and be affixed to the panel by fastening means whereby the fastening means does not protrude to the front of the lower panel.

3. The mounting rail assembly of claim 2 wherein the lower panel portion bead member (123) includes an L shaped bead member (123) having a hooked shaped base (146) and upright portion (145), whereby the upright portion (145) is adapted to be fastened to the lower portion of the upper panel and hook shaped base (146) in use adapted to be received by the upper throat (128) and be held in place by a hook (126) as provided by a vertical upstanding rear flange (125).

4. The mounting rail assembly of claim 1, wherein, the mounting rail (121) is a powder coated metal.

5. A mounting rail assembly for flush mounting cladding panels to a wall of a building, for forming a drained and ventilated cladding system for the wall, the mounting rail assembly (103) comprising:

a mounting rail (121) mountable on the wall of the building, the mounting rail (121) comprising i) an upright leg (125), ii) a downwardly facing hook (126) extending from off an upper part of the upright leg (125) on a side of upright leg (125) facing away from the wall, iii) a cantilever portion (127), extending from off the upright leg (125) below the hook (126) and on the side of upright leg (125) facing away from the wall, the cantilever portion (127) including a downwardly extending hook (127*a*) angled inwards towards the wall, iv) an upper throat (128) located between a lower side of the hook (126) and an upper side of the cantilever portion (127), v) a downwardly curved horizontal arm (129) located and extending from a lower base of the upright leg (125), and vi) a lower throat (131) located between a lower surface of cantilever portion (127) and an upper surface of the horizontal arm (129);

an upper panel portion bead member (122) that vertically mounts an upper portion of a lower panel in air spaced position from the wall of the building, the upper panel portion bead member (122) being slidably interlocked with the mounting rail (121) by the horizontal arm; and a lower panel portion bead member (123) that vertically mounts a lower portion of an upper panel, the lower panel portion bead member (123) comprising an upright vertical leg (145) and horizontal leg (146), the vertical leg (145) attachable to a back of the lower portion of the upper panel, the horizontal leg (146) having an upturned end edge (148) which, when assembled with the downwardly facing hook (126), is rotatably and slidably slotted into the upper throat (128), wherein, when the upper and lower panels are mounted, a horizontal gap is present between a lowermost edge of the lower portion of the upper panel and a capped uppermost edge of the lower panel, outer faces of the upper and lower panels being free of any exposed fasteners, and the upper and lower panels are mounted oriented in the vertical plane, the upper and lower throats are elongate shaped spaces with a mouth at a front opening in a horizontal plane whereby the lower panel bead portion and upper panel bead portion each cantilever within the respective upper and lower throats to be supported therefrom thereby supporting the panels in the vertical plane.

6. The mounting rail assembly of claim 5, wherein, the horizontal arm (129) ends with ending in a downwardly extending vertical arm (130) such that when fitted with the upper panel portion bead member (122), an outer face of the downward arm (130) abuts a portion of the upper panel portion bead member (122), the horizontal arm (129) further comprising a seat (129*a*) located at a top of the vertical arm (130), the upper panel portion bead member (122) comprising a tab (137*b*) that rests on the seat (129*a*), and the upper panel portion bead member (122) is slidable on seat (129*a*) of the horizontal arm (129) when installing the panels.

7. The mounting rail assembly of claim 6, wherein, the mounting rail (121) further comprises an end flashing fixing part (129*b*), with a three quarter circular element located underneath, located at the lower base of the upright leg (125) at a junction of the upright leg (125) and the horizontal arm (129).

8. The mounting rail assembly of claim 6, wherein, the panel portion bead member (122) includes stepped portions for fixing the top of each panel to the mounting rail (121), the stepped portions defined by plural flange portions (135, 136, 137, 137*a* & 137*b*) supported and protruding in opposite directions from a vertical web base (138), the flange portions include i) from a top of the web base (138), a first, upwardly angled portion (137) angled towards the wall and leading to a second, upright portion (135) and a third, end part portion (136) angled back away from the wall and towards the mounted panels, ii) also from the top of the web base (138), a fourth, horizontal flange portion (137*a*) pointing out away from the wall, and iii) a fifth flange portion located below the top of the web base (138) and pointing toward the wall defining the tab (137*b*) that rests on the seat (129*a*) when the upper panel portion bead member (122) is inserted into the lower throat (131) of the mounting rail (121), the fourth, horizontal flange portion (137*a*) is located parallel and below cantilever portion (127) and caps a top of the mounted lower panel, and the vertical web base, when mounting the lower panel, abuts an outer side of the vertical arm (130).

9. The mounting rail assembly of claim 8, further comprising:

fastening elements (140) that fasten a lower end of the vertical web base (138) to the upper portion of the lower panel, wherein the fastening elements (140) do not protrude to a front of the lower panel.

10. The mounting rail assembly of claim 8, wherein the second, upright portion (135) and third, end part (136) close off the upper throat.

11. The mounting rail assembly of claim 5, wherein, the horizontal leg (146) of the lower panel portion bead member (123) includes a downwardly angled tab hook (151) which abuts the cantilever portion (127) of the mounting rail (121) whereby the upturned end edge (148) is inserted into the upper throat (128) with the downwardly facing hook (126) holding the upturned end edge (148) in place and with the horizontal leg (146) resting on cantilever portion (127).

12. The mounting rail assembly of claim 5, wherein, the horizontal leg (146) of the lower panel portion bead member (123) includes a moisture-draining aperture (150) that allows moisture in a cavity behind the upper panel to exit.

13. The mounting rail assembly of claim 5, wherein, the mounting rail (121) is a powder coated metal.

14. A mounting rail assembly flush mounting cladding panels to a wall of a building and forming a drained and ventilated cladding system for the wall, comprising:

an upper panel and a lower panel;

a mounting rail (121) mounted on the wall of the building;

an upper panel portion bead member (122) vertically mounting an upper portion of the lower panel in air spaced position from the wall of the building, the upper panel portion bead member (122) being slidably interlocked with the mounting rail (121) by a horizontal arm; and a lower panel portion bead member (123) with moisture draining apertures (150) that i) vertically mounts a lower portion of the upper panel and ii) allows moisture in a cavity behind the upper panel to exit, the lower panel portion bead member (123) being rotatably and slidably slotted into an upper throat (128), wherein, a horizontal gap is present between a lowermost edge of the lower portion of the upper panel and a capped uppermost edge of the lower panel, outer faces of the upper and lower panels being free of any exposed fasteners, and the upper and lower panels are mounted oriented in the vertical plane, the upper and a lower throat are elongate shaped spaces with a mouth at a front opening in a horizontal plane whereby the lower panel bead portion and upper panel bead portion each cantilever within the respective upper and lower throats to be supported therefrom thereby supporting the panels in the vertical plane.

15. The mounting rail assembly of claim 14, wherein, the mounting rail (121) comprises i) an upright leg (125), ii) a downwardly facing hook (126) extending from off an upper part of the upright leg (125) on a side of upright leg (125) facing away from the wall, iii) a cantilever portion (127), extending from off the upright leg (125) below the hook (126) and on the side of upright leg (125) facing away from the wall, the cantilever portion (127) including a downwardly extending hook (127*a*) angled inwards towards the wall, iv) the upper throat (128) is located between a lower side of the hook (126) and an upper side of the cantilever portion (127), v) a downwardly curved horizontal arm (129) located and extending from a lower base of the upright leg (125), and vi) the lower throat (131) is located between a lower surface of cantilever portion (127) and an upper surface of the horizontal arm (129), the lower panel portion bead member (123) comprising an upright vertical leg (145) and horizontal leg (146), the vertical leg (145) attachable to a back of the lower portion of the upper panel, the horizontal leg (146) having an upturned end edge (148) which, when assembled with the downwardly facing hook (126), is rotatably and slidably slotted into the upper throat (128), the horizontal arm (129) ends with ending in a downwardly extending vertical arm (130) such that when fitted with the upper panel portion bead member (122), an outer face of the downward arm (130) abuts a portion of the upper panel portion bead member (122), the horizontal arm (129) further comprising a seat (129*a*) located at a top of the vertical arm (130), the upper panel portion bead member (122) comprising a tab (137*b*) that rests on the seat (129*a*), and the upper panel portion bead member (122) is slidable on seat (129*a*) of the horizontal arm (129) when installing the panels.

16. The mounting rail assembly of claim 15, wherein, the panel portion bead member (122) includes stepped portions for fixing the top of each panel to the mounting rail (121), the stepped portions defined by plural flange portions (135, 136, 137, 137*a* & 137*b*) supported and protruding in opposite directions from a vertical web base (138), the flange portions include i) from a top of the web base (138), a first, upwardly angled portion (137) angled towards the wall and leading to a second, upright portion (135) and a third, end part portion (136) angled back away from the wall and towards the mounted panels, ii) also from the top of the web base (138), a fourth, horizontal flange portion (137*a*) pointing out away from the wall, and iii) a fifth flange portion located below the top of the web base (138) and pointing toward the wall defining the tab (137*b*) that rests on the seat (129*a*) when the upper panel portion bead member (122) is inserted into the lower throat (131) of the mounting rail (121), the fourth, horizontal flange portion (137*a*) is located parallel and below cantilever portion (127) and caps a top of the mounted lower panel, the vertical web base, when mounting the lower panel, abuts an outer side of the vertical arm (130), and wherein the second, upright portion (135) and third, end part (136) close off the upper throat.

17. The mounting rail assembly of claim 14, wherein, the mounting rail (121) is a powder coated metal.

18. The mounting rail assembly of claim 14, wherein, the horizontal leg (146) of the lower panel portion bead member (123) includes a downwardly angled tab hook (151) which abuts the cantilever portion (127) of the mounting rail (121) whereby the upturned end edge (148) is inserted into the upper throat (148) with the downwardly facing hook (126) holding the upturned end edge (148) in place and with the horizontal leg (146) resting on cantilever portion (127).

19. The mounting rail assembly of claim 14, wherein, the horizontal leg (146) of the lower panel portion bead member (123) includes a moisture-draining aperture (150) that allows moisture in a cavity behind the upper panel to exit.

* * * * *